US009134646B2

(12) United States Patent
Ishida

(10) Patent No.: US 9,134,646 B2
(45) Date of Patent: Sep. 15, 2015

(54) IMAGE FORMING APPARATUS HAVING DEVELOPMENT BIAS CONTROL

(75) Inventor: Yusuke Ishida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 139 days.

(21) Appl. No.: 13/572,069

(22) Filed: Aug. 10, 2012

(65) Prior Publication Data

US 2013/0058665 A1 Mar. 7, 2013

(30) Foreign Application Priority Data

Sep. 1, 2011 (JP) ..... 2011-190758

(51) Int. Cl.
*G03G 15/06* (2006.01)
*G03G 15/08* (2006.01)
*G03G 15/00* (2006.01)

(52) U.S. Cl.
CPC ..... *G03G 15/065* (2013.01); *G03G 15/0896* (2013.01); *G03G 15/6591* (2013.01)

(58) Field of Classification Search
CPC ..... G03G 15/065; G03G 15/6591; G03G 15/0896
USPC ..... 399/29, 44, 45, 55
See application file for complete search history.

(56) References Cited

U.S. PATENT DOCUMENTS 5,960,232 A * 9/1999 Cheng
2007/0217802 A1* 9/2007 Watanabe
2008/0175606 A1* 7/2008 Okada
2011/0052220 A1* 3/2011 Nose ..... 399/44
2012/0301159 A1* 11/2012 Takahashi ..... 399/44
2013/0058664 A1* 3/2013 Ishida ..... 399/29

FOREIGN PATENT DOCUMENTS

JP 62127870 A * 6/1987 ..... G03G 15/06
JP 2000-310909 A 11/2000
JP 2001042613 A * 2/2001 ..... G03G 15/06
JP 3604000 B2 12/2004
JP 2005-62473 A 3/2005
JP 2006-30978 A 2/2006
JP 4479185 B2 6/2010
JP 2010-250051 A 11/2010
JP 4719515 B2 7/2011

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes an image bearing member, a development device that includes a developer bearing member in a development position opposite to the image bearing member to develop an electrostatic latent image formed on the image bearing member, and a bias applying portion that applies a development bias to the developer bearing member. A degradation sensing portion senses information related to a level of degradation of toner stored in the development device, and an acquisition portion acquires information on a type of a recording material to which a toner image developed by the development device is transferred. In addition, a controlling portion controls a condition of the bias applied to the developer bearing member so that a development ability of the development device is decreased when the degradation sensing portion senses information that the level of degradation of toner is less than a predetermined level and the acquisition portion acquires information that smoothness of the recording material is more than a predetermined reference.

8 Claims, 18 Drawing Sheets

IMAGE FORMING APPARATUS HAVING DEVELOPMENT BIAS CONTROL

BACKGROUND OF THE INVENTION

1. Field of the Invention

The present invention relates to an electrophotographic image forming apparatus provided with a development device.

2. Description of the Related Art

Generally, in an electrophotographic image forming apparatus, an image is formed through an image forming process. The image forming process includes a charging process, an exposure process, a development process, a transfer process, a fixing process, and a cleaning process.

In the image formation, a surface of an electrophotographic photosensitive body (hereinafter referred to as a "photosensitive body") is evenly charged. Then the photosensitive body is exposed according to image information to form an electrostatic latent image. When toner is supplied to the electrostatic latent image, the electrostatic latent image becomes a toner image. Then the toner image formed on the photosensitive body is transferred onto a recording material such as a sheet. A fixing process heats and pressurizes the recording material to which the toner image is transferred, thereby fixing the toner image to the surface of the recording material. Therefore, the image formation to the recording material is ended. On the other hand, transfer residual toner remains on the surface of the photosensitive body after the toner image is transferred. The transfer residual toner is removed through the cleaning process.

Conventionally, a two-component development system in which non-magnetic toner (toner) and a magnetic carrier (carrier) are mixed and used as a developer is widely spread in the electrophotographic image forming apparatus, particularly in the image forming apparatus that forms a color image. Compared with other currently-well-known development systems, the two-component development system has advantages, such as stability of image quality and durability of the apparatus.

In the image forming apparatus in which the two-component development system is used, generally the following sequence is performed when the toner image is formed by developing the electrostatic latent image formed on the photosensitive drum that is of an image bearing member. First the surface of the photosensitive drum is evenly charged by a charging portion so as to become a white-background-part potential Vd. A development bias is applied to a development sleeve that is of a developer bearing member, and the development sleeve is set to a potential identical to a direct-current component Vdc of the development bias.

At this point, a potential difference between the white-background-part potential Vd and the direct-current component Vdc of the development bias is set so as to become a desired fog removing potential difference Vback. An image part (development part) on the photosensitive drum is exposed by an exposure portion that forms the electrostatic latent image, thereby becoming an attenuated bright-part potential VL. The toner on the development sleeve moves to the photosensitive drum by a contrast potential difference Vcont that is of a difference with the direct-current component Vdc of the development bias. Thus, the electrostatic latent image formed on the photosensitive drum is developed as the toner image.

Generally, in the two-component development system, when the toner is consumed because of the image formation, the toner is replenished according to the consumed toner.

Therefore, the toner in the developer is sequentially replaced by repeating the image formation.

However, the following problem is generated in the image forming apparatus in which the two-component development system is adopted.

Nowadays, various sheet types are used as the recording material. Examples of the recording material include inexpensive paper (such as recycled paper) having low surface smoothness, paper having high smoothness, and coated paper. Among them, for the paper having the low smoothness, a toner transfer characteristic is changed along a shape of a paper surface, and uneven transfer is easily generated.

Generally a transfer condition (transfer bias) is changed according to a setting of a sheet type (such as plain paper, recycled paper, thick paper, and OHT) that is selected by a user. However, when the toner is degraded due to lasting, a temperature rise and the like, it is difficult to maintain the transfer characteristic to the paper through the lasting.

On the other hand, generally the surface of the toner is covered with an additive (hereinafter referred to as an external additive) in order to maintain fluidity of the toner. The external additive is a particle derived from alumina or silica, and the external additive has particle diameters of tens to hundreds of nanometers. The fluidity is provided to the toner when the external additive is added, so that the toner can efficiently be transferred to the paper.

However, generally the shape and particle diameter of the toner vary. Therefore, an external additive coverage per one particle of the toner also varies. While a certain toner particle is stably covered with the external additive, sometimes another toner particle is covered with a small amount of external additive.

In the case that the toner covered with a small amount of external additive is supplied, when the image is formed on the paper having the low smoothness, the toner covered with a small amount of external additive is insufficiently transferred, and possibly the uneven transfer is generated. For example, in the case that the toner covered with a small amount of external additive is included, it is difficult to maintain the transfer characteristic to various sheet types.

When the image forming operation is performed for a long period of time, sometimes a decrease of an adhesion amount of the external additive is generated. Specifically, when the image (an image having a low print coverage) in which toner consumption amount is small is continuously output, a small amount of toner is replaced in the developer. As a result, the toner that is not replaced exists in the development device for a long time, the toner that is not replaced circulates in the development device for a long period of time. When the toner exists in the development device for a long time, the toner is repeatedly slid and agitated, and the external additive is buried in the surface of the toner. Therefore, there is a risk of degrading the fluidity of the developer. When the fluidity of the developer is degraded, adhesion between the toner and the image bearing member is increased to decrease the transfer characteristic. Particularly, the transfer characteristic to the paper having the low smoothness is degraded.

For example, Japanese Patent Laid-Open No. 2000-310909 discloses a technology of suppressing the degradation of the fluidity of the toner. In Japanese Patent Laid-Open No. 2000-310909, a unit calculates a print coverage of the formed image, and the toner is forcedly consumed by developing a predetermined amount of toner in a non-image region when the calculated print coverage is less than a predetermined value. The new toner corresponding to the consumed toner is replenished to the development device, and the degraded toner is replaced with the new toner. Performing such a control prevents the uneven transfer, which is generated by not replacing the toner in the development device when the image having the low print coverage is continuously output.

In Japanese Patent Laid-Open No. 2000-310909, it is expected that a fixed effect is obtained when the transfer defect is generated because the toner is degraded by the use of the image forming apparatus. However, originally the external additive coverage per one particle of the toner varies as described above. Therefore, the developed toner includes the toner having a small amount of external additive. In this case, when the low-smoothness paper, such as an embossed paper, is used, sometimes the uneven transfer is generated even if the toner is replaced.

SUMMARY OF THE INVENTION

The invention is intended to set the development bias corresponding to a level of degradation to maintain a stable toner transfer characteristic to the recording material.

In a typical configuration of the invention, an image forming apparatus includes: an image bearing member; a development device that includes a developer bearing member in a development position opposite to the image bearing member to develop an electrostatic latent image formed on the image bearing member, the developer bearing member bearing and conveying a developer; a bias applying portion that applies a development bias to the developer bearing member; a recording-material sensing portion that senses a type of a recording material to which a toner image developed by the development device is transferred; and a controller that controls the bias applying portion to apply the development bias that degrades a development characteristic when the recording material has low smoothness from a sensing result of the recording-material sensing portion.

Further features of the present invention will become apparent from the following description of exemplary embodiments with reference to the attached drawings.

DESCRIPTION OF THE EMBODIMENTS

Hereinafter, an image forming apparatus according to an embodiment of the invention will be described in detail with reference to the drawings.

Figure 1:
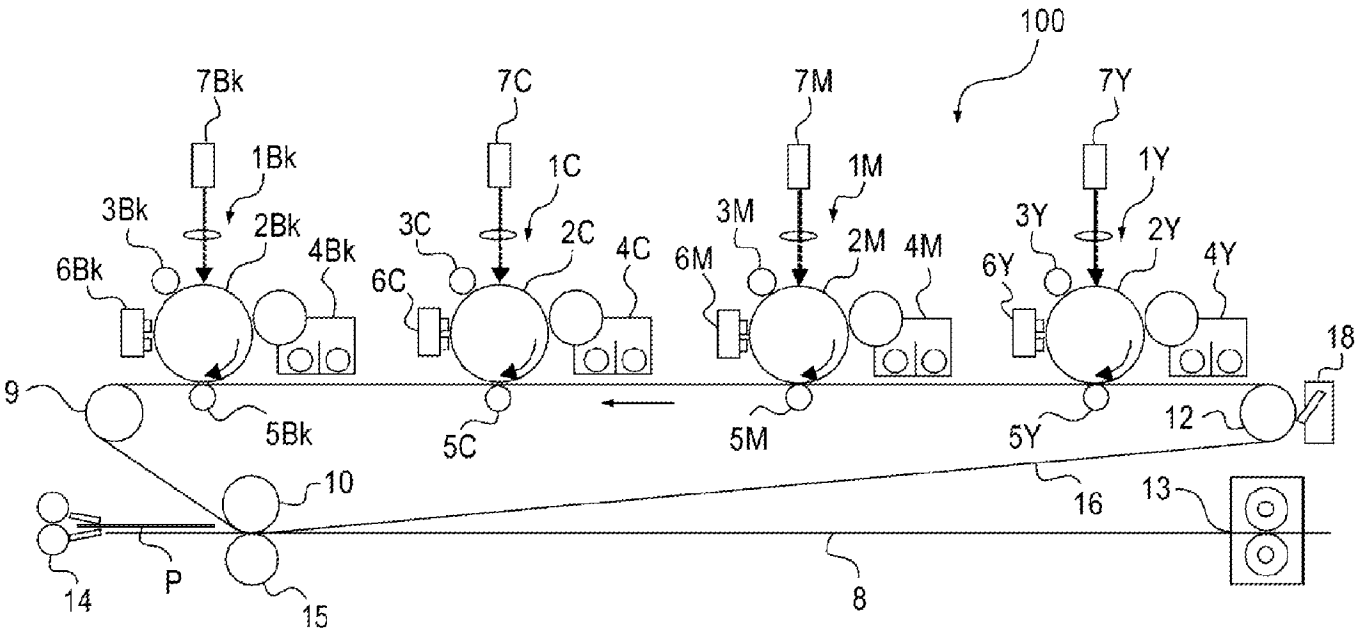
FIG. 1 is a schematic configuration diagram illustrating an example of an image forming apparatus according to a first embodiment.

[First Embodiment] (Configuration of Image Forming Apparatus) An entire configuration and an entire operation of an image forming apparatus according to a first embodiment will be described below. FIG. 1 is a schematic configuration diagram illustrating an example of the image forming apparatus of the first embodiment.

An image forming apparatus 100 is an electrophotographic full-color printer. The image forming apparatus 100 includes four image forming portions 1 (1Y, 1M, 1C, and 1Bk) that are provided according to four colors of yellow Y, magenta M, cyan C, and black Bk.

In the first embodiment, the four image forming portions 1 (1Y, 1M, 1C, and 1Bk) included in the image forming apparatus 100 have a substantially identical configuration except that development colors differ from one another. Accordingly, unless otherwise noted, the suffixes Y, M, C, and Bk added to the numeral in order to express an element belonging to which color of the image forming portion are not given to generally describe the image forming portion.

The image forming apparatus 100 receives an image signal from an original reading device connected to an image forming apparatus body and a host apparatus such as a personal computer that is connected to the image forming apparatus body in a communicable manner. In response to the image signal, the image forming apparatus 100 forms a four-color, full-color image on a recording material. Examples of the recording material include a recording sheet, a plastic film, and a cloth.

Each of the image forming portion 1 includes photosensitive drum 2 (2Y, 2M, 2C, and 2Bk) that is of the image bearing member. The image forming apparatus 100 has a configuration, in which a toner image formed on the photosensitive drum 2 is primarily transferred to an intermediate transfer belt 16 and secondarily transferred to a recording material P conveyed by a recording-material bearing member 8. The detailed description will be made below.

The photosensitive drum 2 is a cylindrical photosensitive body that is rotated in a direction of an arrow in FIG. 1. A charging roller 3 (charging member), a development device 4 (development portion), a primary transfer roller 5 (primary transfer member), a secondary transfer roller 15 (secondary transfer member), a secondary transfer counter roller 10, and a cleaning device 6 (cleaning member) are disposed around the photosensitive drum 2. A laser scanner 7 (exposure portion) is disposed above the photosensitive drum.

The intermediate transfer belt 16 is disposed opposite all the photosensitive drums 2 of the image forming portion 1. The intermediate transfer belt 16 is tensioned by a drive roller 9, the secondary transfer counter roller 10, and a tension roller 12, and moves circularly in a direction of an arrow in FIG. 1 by drive of the drive roller 9.

As described above, the toner image formed on the photosensitive drum 2 is primarily transferred to the intermediate transfer belt 16, and secondarily transferred to the recording material P conveyed by the recording-material bearing member 8. After the toner image is secondarily transferred from the intermediate transfer belt 16 to the recording material P, the toner image is thermally fixed to the recording material P by a fixing device 13.

(Image Forming Operation) Taking the formation of the four-color, full-color image as an example, an operation of the image forming apparatus having the above configuration will be described.

When the image forming operation starts, the charging roller 3 evenly charges a surface of the rotating photosensitive drum 2. At this point, a charging bias power supply applies a charging bias to the charging roller 3.

Then the photosensitive drum 2 is exposed with a laser beam emitted from the laser scanner 7 according to the image signal. Therefore, an electrostatic latent image is formed on the photosensitive drum 2 according to the image signal. The electrostatic latent image on the photosensitive drum 2 is visualized by toner stored in the development device 4, thereby forming a visible image (toner image). A reversal development system, in which the toner adheres to a potential at a bright-portion exposed with the laser beam, is used in the first embodiment.

The toner image on the photosensitive drum 2 is secondarily transferred onto the intermediate transfer belt 16. After the primary transfer, the toner (transfer residual toner) remaining on the surface of the photosensitive drum 2 is removed by the cleaning device 6. The operation is sequentially performed by the image forming portions 1 corresponding to the colors of yellow, magenta, cyan, and black, whereby the toner images of four colors are superimposed on the intermediate transfer belt 16.

Then the recording material P accommodated in a recording material storage cassette is conveyed by a supply roller 14 and the recording-material bearing member 8 according to the formation of the toner image. By applying a secondary transfer bias to the secondary transfer roller 15, the toner images of four colors on the intermediate transfer belt 16 are collectively secondarily transferred onto the recording material P borne on the recording-material bearing member 8.

Then the recording material P is separated from the recording-material bearing member 8 and conveyed to the fixing device 13. The fixing device 13 heats and pressurizes the recording material P. Therefore, the toner on the recording material P is melted and mixed to fix the full-color permanent image to the recording material P. Then the recording material P is discharged outside of the apparatus.

The toner, which is not transferred in the secondary transfer portion but remains on the intermediate transfer belt 16, is removed by an intermediate transfer belt cleaner 18. Therefore, a series of image forming operations is ended. An image of a desired single color or plural colors can also be formed using only the desired image forming portion.

Figure 2:
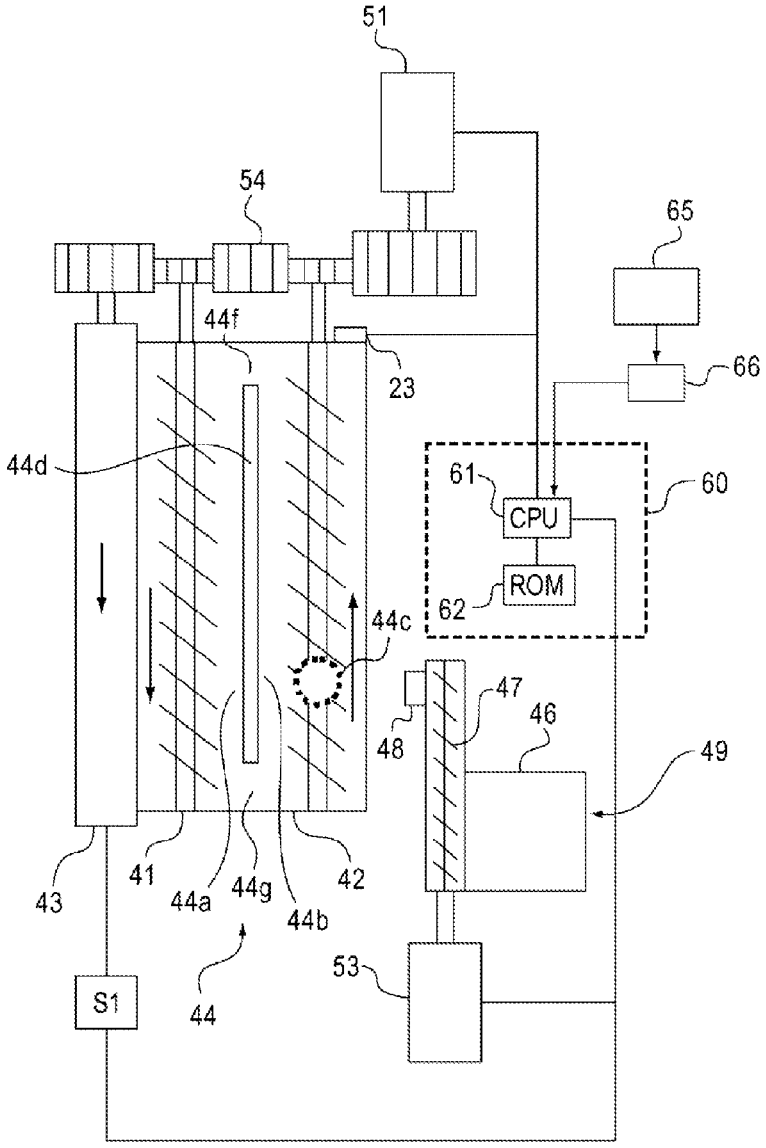
FIG. 2 is an explanatory view illustrating a development device and a toner replenishing portion of the first embodiment.

(Development Device) The development device 4 will be described below with reference to FIG. 2. FIG. 2 is an explanatory view illustrating the development device and a toner replenishing portion of the first embodiment. In the first embodiment, the yellow, magenta, cyan, and black development devices have the identical configuration.

The development device 4 includes a developing container 44 in which a two-component developer is stored. The two-component developer mainly contains a non-magnetic toner particle (toner) and a magnetic carrier particle (carrier).

A coloring resin particle and an external additive are added to the toner. The coloring resin particle contains a binding resin and a colorant, and the coloring resin particle also contains other additives as needed basis. Examples of the external additive include a colloidal silica fine particle and titanium oxide. The external additive covers the toner to provide fluidity to the toner. Therefore, a development characteristic and the transfer characteristic of the toner are improved to the recording material. Generally the development characteristic and the transfer characteristic are improved with increasing amount of external additive covering the toner. On the other hand, when the external additive is excessively contained, there is a risk of generating a toner charging defect due to carrier contamination. Therefore, it is necessary to properly adjust an additive amount of the external additive.

In the first embodiment, the amount of external additive covering the toner is set to 2.5% with respect to a toner weight. The toner is a negatively-charged polyester resin produced by a polymerization method, and preferably a mean volume diameter of the toner range from 5 μm to 8 μm. In the first embodiment, the toner has the mean volume diameter of 6.2 μm.

For example, metals, such as iron, nickel, cobalt, manganese, chromium, and rare-earth elements, in which the surface is oxidized or not oxidized, and alloys thereof, and ferrite oxide are suitably used as the carrier. There is no particular limitation to a method for producing the magnetic particle. A mean weight diameter of the carrier ranges from 20 to 50 μm, preferably 30 to 40 μm, and a resistivity of the carrier is greater than or equal to $10^7$ Ω·cm, preferably greater than or equal to $10^8$ Ω·cm. The carrier having the resistivity of $10^8$ Ω·cm is used in the first embodiment.

A resin magnetic carrier, which is produced by the polymerization method while magnetic metal oxide and non-magnetic metal oxide are mixed in a phenol binder resin with a predetermined ratio, is used as a low-specific-gravity magnetic carrier in the first embodiment. The resin magnetic carrier has the mean volume diameter of 35 μm, a real density of 3.6 to 3.7 g/cm$^3$, and a magnetization of 53 A·m$^2$/kg.

A first agitation and conveyance screw 41 (first agitation member) and a second agitation and conveyance screw 42 (second agitation member), which are of the member agitating and conveying the developer, are rotatably disposed in the developing container 44. In the developing container 44, a development sleeve 43 that bears and conveys the developer is rotatably disposed in a development position opposite to the photosensitive drum 2. At this point, the first agitation and conveyance screw 41, the second agitation and conveyance screw 42, and the development sleeve 43 are provided in parallel with one another.

The inside of the developing container 44 is divided into a development chamber 44*a* (first chamber) and an agitation chamber 44*b* (second chamber) by a partition 44*d*. The development chamber 44*a* and the agitation chamber 44*b* are communicated with each other at both end portions in a longitudinal direction of the developing container 44. The first agitation and conveyance screw 41 is provided in the development chamber 44*a*, and the second agitation and conveyance screw 42 is provided in the agitation chamber 44*b*.

A magnet roll (not illustrated) that is of the magnetic-field generating portion is fixedly disposed in the development sleeve 43. The magnet roll includes plural magnetic poles in a circumferential direction. The magnet roll attracts the developer in the developing container 44 by a magnetic force to bear the developer on the development sleeve 43, and forms a magnetic brush of the developer in the development portion opposite to the photosensitive drum 2.

The first agitation and conveyance screw 41, the second agitation and conveyance screw 42, and the development sleeve 43 are rotated by a development-side drive motor 51. The development-side drive motor 51 transmits a drive force to the first agitation and conveyance screw 41 and the second agitation and conveyance screw 42 through a gear train 54, thereby rotating the first agitation and conveyance screw 41 and the second agitation and conveyance screw 42 in an identical rotating direction.

The developer in the agitation chamber 44*b* is conveyed by the rotation of the second agitation and conveyance screw 42 while agitated. The developer moves into the development chamber 44*a* through a communication hole 44*f* that constitutes the communication portion. The developer that reaches the development chamber 44*a* moves while being agitated by the first agitation and conveyance screw 41. The developer moves into the agitation chamber 44*b* through a communication hole 44*g* that constitutes the communication portion. Thus, the developer circulates in the developing container 44. A charge is provided to the developer during the agitation and conveyance process.

The development sleeve 43 conveys the developer, which is applied in layers onto the surface of the development sleeve 43 by a regulation blade (not illustrated), to the development portion opposite to the photosensitive drum 2 by the rotation of the development sleeve 43. In the development portion, the developer on the development sleeve 43 forms the magnetic brush by the magnetic force of the magnet roll. The developer that forms the magnetic brush comes into contact or close to the surface of the photosensitive drum 2.

On the other hand, a development-bias applying power supply S1 applies the development bias to the development sleeve 43 when the electrostatic latent image on the photosensitive drum 2 reaches the development portion. In the first embodiment, during the image formation, the development bias applied to the development sleeve 43 is an oscillation voltage in which a DC voltage component (Vdc) and an AC voltage component (Vac) are superposed.

In the above configuration, the toner in the developer transitions to the electrostatic latent image on the surface of the photosensitive drum 2 by the development bias that can be applied by the development-bias applying power supply S1 (development bias applying portion).

(Toner Replenishing Configuration) A toner replenishing operation that is of a toner degradation suppressing function in the first embodiment will be described below. As illustrated in FIG. 2, the toner is replenished through a toner replenishment port 44*c* provided at the top of the agitation chamber 44*b* on an upstream end portion side in a developer conveying direction.

When the toner in the two-component developer is consumed by the development operation, toner density of the developer in the developing container 44 is gradually decreased. In order to maintain the toner density, a toner replenishing portion 49 (toner replacing portion) replenishes the toner to the developing container 44. The toner replenishing portion 49 includes a toner container 46 in which the toner to be replenished is stored. In consuming the toner, the toner in the development device 4 is replaced such that the toner replenishing portion 49 replenishes the toner to the toner container 46.

The toner stored in the toner container 46 is supplied from a toner discharge port 48. The toner discharge port 48 is coupled to the toner replenishment port 44*c* of the developing container 44. A toner replenishing screw 47 (toner replenishing member) is provided in the toner container 46 in order to convey the toner toward the toner discharge port 48. The toner replenishing screw 47 is rotated by a replenishment-side drive motor 53.

As illustrated in FIG. 2, the rotations of the development-side drive motor 51 and the replenishment-side drive motor 53 are controlled by a CPU 61 (controller) of an engine controller 60 included in the image forming apparatus body. The CPU 61 controls a rotating time of the replenishment-side drive motor 53 to adjust the amount of toner replenished to the developing container 44.

A correspondence relationship between the rotating time of the replenishment-side drive motor 53 and the amount of toner replenished to the developing container 44 is previously measured by an experiment. For example, the experimental result of the correspondence relationship is stored as table data in the CPU 61 or a ROM 62 connected to the CPU 61.

A storage device 23 is placed in the development device 4. In the first embodiment, a readable, writable RP-ROM is used as the storage device 23. The development device 4 is set into the image forming apparatus body to electrically connect the storage device 23 to the CPU 61, and image forming process information on the development device 4 can be read and written from a printer side. A console panel 65 that is operated by a user is provided in the image forming apparatus 100, and a "plain-paper mode" and a "recycled-paper mode" can be selected on the console panel 65. When the user selects one of the "plain-paper mode" and the "recycled-paper mode", a recording-material sensing portion 66, which is the acquisition portion that acquires information on a type of a recording material, senses a selection signal and transmits the selection signal to the CPU 61.

Figure 3:
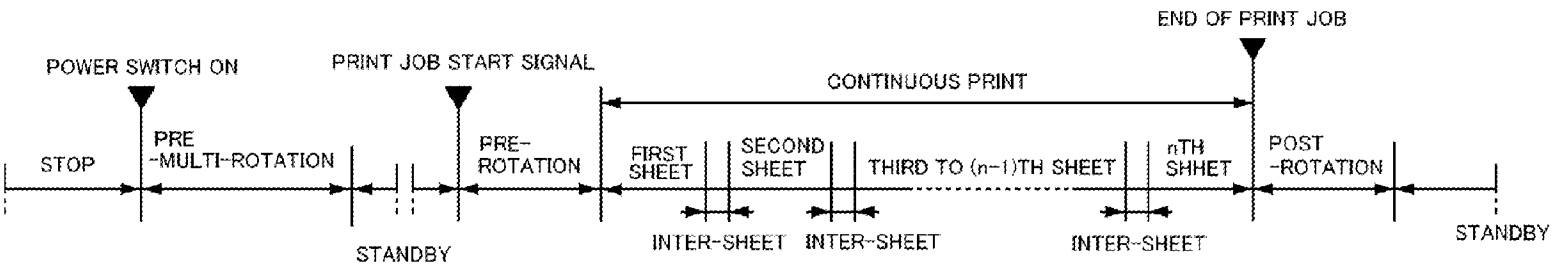
FIG. 3 is a view illustrating a process of operating the image forming apparatus of the first embodiment.

(Process of Operating Image Forming Apparatus) A process of operating the image forming apparatus will be described with reference to FIG. 3. FIG. 3 is a view illustrating the process of operating the image forming apparatus of the first embodiment.

(a) Pre-Multi-Rotation Process

An activation (start-up) operation (warming operation) of the image forming apparatus is performed.

A main power switch of the image forming apparatus is turned on to activate a main motor of the image forming apparatus, thereby performing a preparation operation to required process devices.

(b) Pre-Rotation Process

Based on an input of a print job start signal, the main motor is driven again to perform a pre-print-job operation to required process devices. More actually, the pre-rotation process is performed in the following sequence. That is, 1. the image forming apparatus receives the print job start signal, 2. A formatter expands the image (an expansion time depends on an image data amount or a processing rate of the formatter), and 3. the pre-rotation process is started. When the print job start signal is input during (a) the pre-multi-rotation process, the process of operating the image forming apparatus transitions to (b) the pre-rotation process without performing (c) standby after (a) the pre-multi-rotation process.

(c) Standby

After the activation operation is performed for a predetermined period, the drive of the main motor is stopped, and the image forming apparatus is maintained in a standby (waiting) state until the print job start signal is input.

(d) Print Job Performance

After the pre-rotation process is performed, the image forming process is performed to output the recording material in which the image is already formed.

For a continuous print job, the image forming process is repeatedly performed to sequentially output a required number of recording materials, in each of which the image is already formed.

(e) Inter-Sheet Process

For the continuous print job, an inter-sheet process is an interval process between a rear end of a certain recording material P and a leading end of the subsequent recording material P, and is an interval of a non-sheet-passing state in the transfer portion or the fixing device 13.

(f) Post-Rotation Process

For the print job of only one sheet, the main motor is continuously driven for a predetermined time after the recording material in which the image is already formed is output. Therefore, the post-rotation process is an interval in which a post-print-job operation is performed to the required process devices. In addition to the output of the recording material P for the print job of only one sheet, for the continuous print job, the same post-print-job operation is also performed after the final recording material in which the image is already formed is output in the continuous print job.

(g) Standby

After the post-rotation process is performed, the drive of the main motor is stopped, and the image forming apparatus is maintained in the standby (waiting) state until the next print job start signal is input.

(d) Print Job Performance is performed in a time in which the image is formed, and (a) Pre-Multi-Rotation Process, (b) Pre-Rotation Process, (e) Inter-Sheet Process, and (f) Post-Rotation Process are performed in a time in which the image is not formed.

As used herein, the time in which the image is formed means a time necessary for at least one of the pre-multi-rotation process, the pre-rotation process, the inter-sheet process, and the (f) post-rotation process, and at least a predetermined time in the process.

In the first embodiment, an image forming rate (the photosensitive drum 2 and a conveying speed of the recording material P, hereinafter referred to as a process speed) is set to 300 mm/sec, and the rotating speed of the development sleeve 43 is set to 400 mm/sec.

A system (video count system), in which a toner consumption amount can be predicted from the number of video counts of image density of image information signal read by a CCD, is adopted in the image forming apparatus of the first embodiment. That is, a level of an output signal of an image signal processing circuit is counted every pixel, and the number of counts is accumulated for the pixels of the sheet size of the original, thereby determining the number of video counts TV per original. For example, for the A4-size sheet, the maximum number of video counts per sheet is 3884×106 for 400 dpi and 256 gray-scale levels. An average print coverage is calculated from integration of the number of video counts and the number of copies.

(External Additive Coverage) An external additive coverage of the toner will be described below. Generally the amount of external additive covering the toner varies because a particle diameter and a shape of the toner vary individually.

Figure 4:
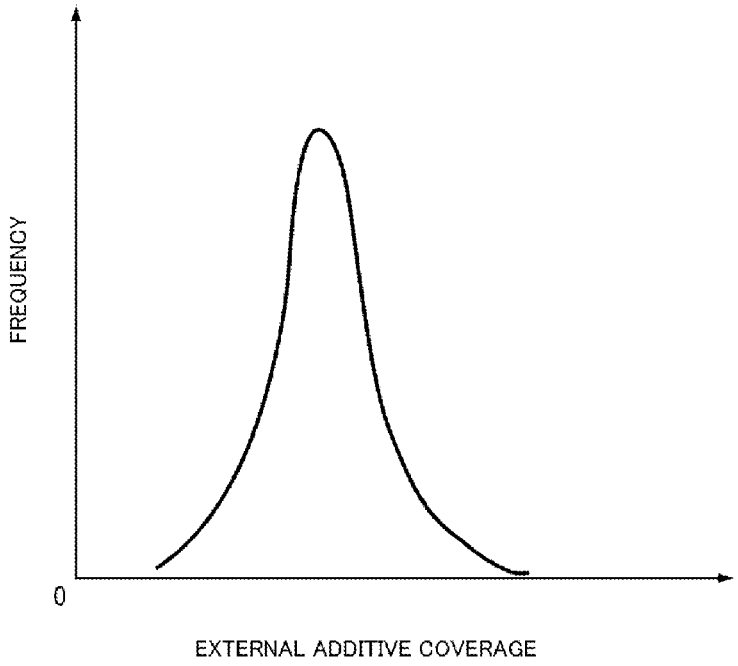
FIG. 4 is an explanatory view illustrating an external additive coverage of toner.

FIG. 4 is an explanatory view illustrating the external additive coverage of the toner. FIG. 4 illustrates a distribution of the external additive coverage per one particle of the toner.

As illustrated in FIG. 4, it is well known that the transfer characteristic of each particle of the toner varies because the amount of external additive covering the toner and the external additive coverage vary.

A secondary transfer characteristic of the toner in the case that smoothness of the recording material varies will be described with reference to FIG. 4.

FIG. 5 is a view illustrating a difference of the secondary transfer characteristic in types of recording materials having different levels of smoothness. FIG. 5 illustrates a relationship between potential at image part/non-image part of the image bearing member in the first embodiment and the bias applied to the developer bearing member.

Figure 5A:
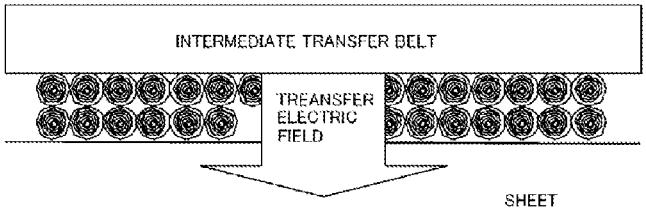
FIG. 5A is a view illustrating a difference of a secondary transfer characteristic in types of recording materials having different levels of smoothness.
Figure 5B:
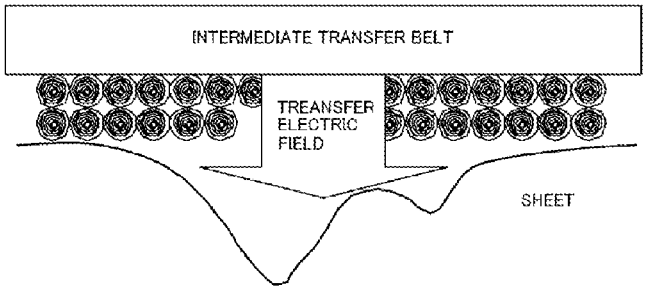
FIG. 5B is a view illustrating the difference of the secondary transfer characteristic in the types of recording materials having the different levels of smoothness.

When the toner on the intermediate transfer belt 16 is transferred to the recording material, a voltage is applied to the secondary transfer roller 15 to form an electric field, thereby transferring the toner to the recording material. At this point, because the recording material having the high smoothness has the high transfer characteristic, the toner is evenly transferred as illustrated in FIG. 5A. On the other hand, because the recording material having the low smoothness has the low transfer characteristic, a micro gap is generated between the intermediate transfer belt 16 and the recording material surface as illustrated in FIG. 5B. Therefore, it is difficult to evenly transfer the toner. Particularly, for the toner having the low external additive coverage, a transfer efficiency is markedly degraded for the use of the recording material having the low smoothness.

The image forming apparatus 100 has the "plain-paper mode" in which the image is formed using plain paper and the "recycled-paper mode" in which the image is formed using the recording material P having the low smoothness. The user can select the "plain-paper mode" and the "recycled-paper mode" on the console panel 65 of the image forming apparatus 100. When one of the "plain-paper mode" and the "recycled-paper mode" is selected on the console panel 65, the mode selection signal is sensed by the recording-material sensing portion 66 and transmitted to the CPU 61.

Figure 6:
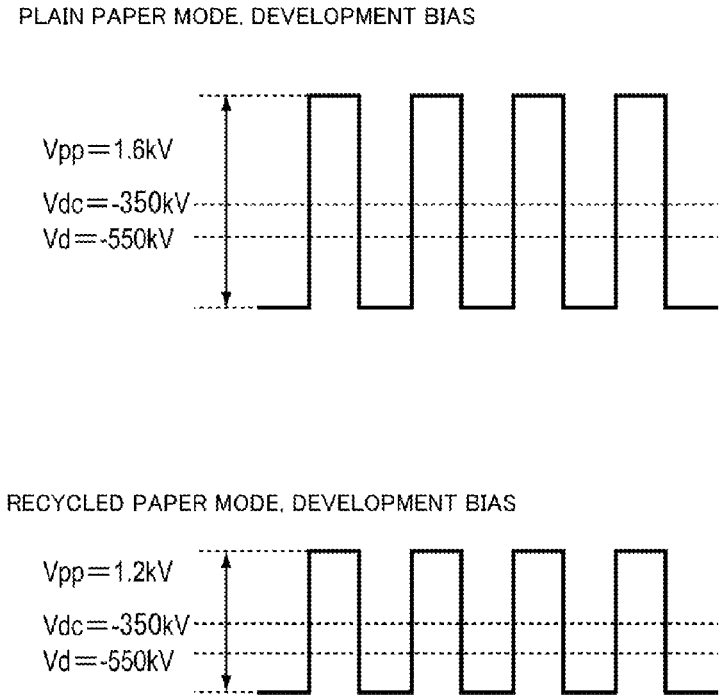
FIG. 6 is an explanatory view illustrating development biases in the first embodiment.

In the first embodiment, the development biases having different rectangular waveforms are applied in the "plain-paper mode" and the "recycled-paper mode", respectively. FIG. 6 is an explanatory view illustrating the development biases in the first embodiment.

In the first embodiment, the oscillation voltage in which a DC voltage of −350 V and a rectangular-waveform AC voltage having a frequency of 10.0 kHz and a peak-to-peak voltage (Vpp) of 1.6 kV are superposed is used as the development bias when the "plain-paper mode" is selected. On the other hand, the development bias having the peak-to-peak voltage of 1.2 kV is used when the "recycled-paper mode" is selected.

The distribution of the external additive coverage per one particle of the toner developed on the photosensitive drum 2 in the case that the peak-to-peak voltage Vpp of the development bias is changed in the first embodiment will be described with reference to FIG. 7. FIG. 7 is an explanatory view illustrating the external additive coverage of the toner.

Figure 7A:
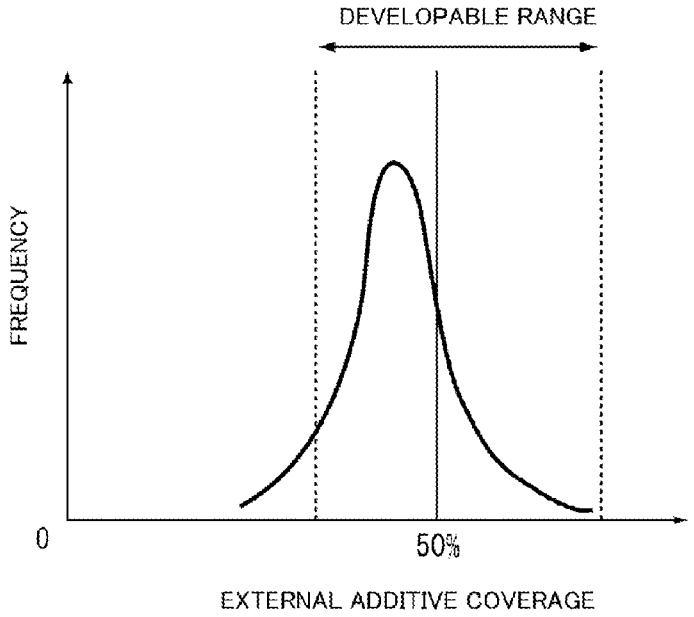
FIG. 7A is an explanatory view illustrating the external additive coverage of the toner.
Figure 7B:
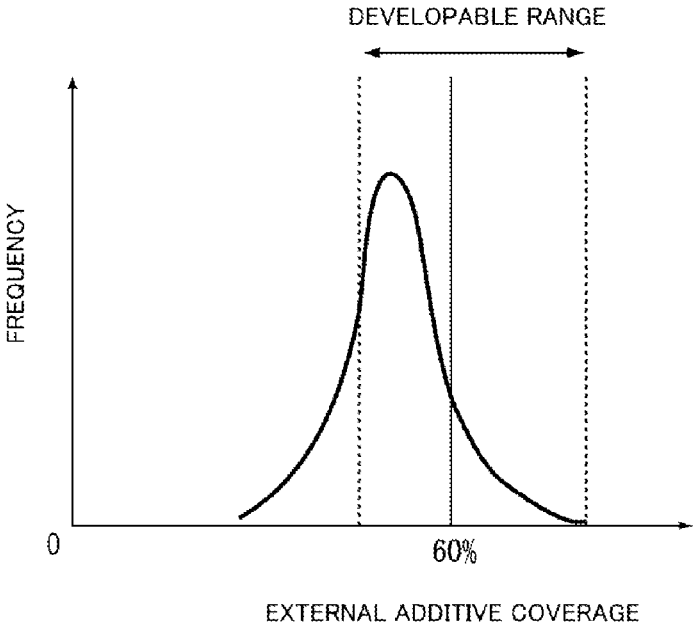
FIG. 7B is an explanatory view illustrating the external additive coverage of the toner.

As illustrated in FIG. 7A, the external additive coverage per one particle of the toner is about 50% in the case that the development bias has the peak-to-peak voltage Vpp of 1.6 kV. On the other hand, as illustrated in FIG. 7B, the external additive coverage per one particle of the toner is about 60% in the case that the development bias has the peak-to-peak voltage Vpp of 1.2 kV.

It is found that, because the peak-to-peak voltage Vpp is low compared with the case in FIG. 7A, the development characteristic is degraded to selectively develop the toner having the higher fluidity, namely, the toner covered with a large amount of external additive. That is, because the toner that is developed in the state of the low peak-to-peak voltage Vpp has the high external additive coverage, the secondary transfer characteristic of the toner is improved. As a result, a defect of transferred colorant is hardly generated.

Figure 8:
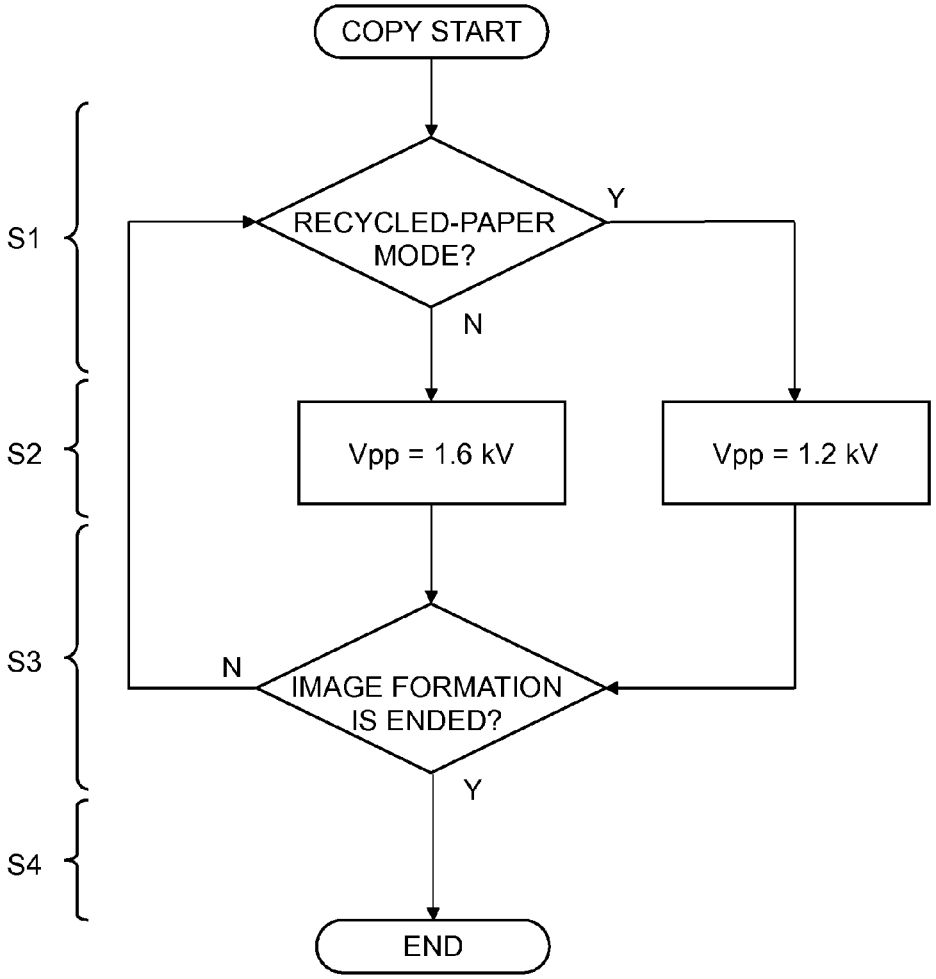
FIG. 8 is a flowchart of the first embodiment.

(Control Flow) A control flow of the first embodiment will be described in detail with reference to FIG. 8. FIG. 8 is a flowchart of the first embodiment.

When the image formation starts, information whether the "plain-paper mode" or the "recycled-paper mode" is selected is taken in the CPU 61 (S1). The peak-to-peak voltage Vpp of the development bias is determined based on sheet type information taken in the CPU (S2).

In the first embodiment, the peak-to-peak voltage Vpp of 1.6 kV is applied when the "plain-paper mode" is selected. On the other hand, the peak-to-peak voltage Vpp of 1.2 kV is applied when the "recycled-paper mode" is selected. Whether the image formation is ended is determined (S3). When the image formation is not continued, the image formation is ended (S4).

As described above, the peak-to-peak voltage Vpp of the development bias is changed according to the selected sheet type. Specifically, the peak-to-peak voltage Vpp of the development bias is increased in the "plain-paper mode" in which the image is transferred to the recording material having the high transfer characteristic. The peak-to-peak voltage Vpp of the development bias is decreased in the "recycled-paper mode" in which the image is transferred to the recording material having the low transfer characteristic. When the peak-to-peak voltage Vpp of the development bias is decreased, the developed toner has the high external additive coverage to improve the secondary transfer characteristic. As a result, the defect of transferred colorant is hardly generated.

The external additive covering state of the developed toner can be controlled according to the selected sheet type, and the toner transfer characteristic can stably be maintained.

[Second Embodiment] A second embodiment will be described below. A basic configuration and operation of an image forming apparatus of the second embodiment are identical to those of the first embodiment. Accordingly, an element having the identical or equivalent function and configuration are designated by the identical numeral to omit the detailed description, and only the feature of the second embodiment is described below.

In the first embodiment, when the "recycled-paper mode" is selected, the development characteristic is degraded because the peak-to-peak voltage Vpp is decreased.

Therefore, in the second embodiment, the oscillation voltage in which the DC voltage of −350 V and the rectangular-waveform AC voltage having the frequency of 10.0 kHz and the peak-to-peak voltage Vpp of 1.6 kV are superposed is used as the development bias when the "plain-paper mode" is selected. Additionally, in the second embodiment, a circumferential velocity of the development sleeve 43 is set to 400 mm/sec.

On the other hand, the development bias having the peak-to-peak voltage of 1.2 kV is used when the "recycled-paper mode" is selected. The circumferential velocity of the development sleeve 43 is set to 500 mm/sec.

In the second embodiment, when the "recycled-paper mode" is selected, the control is performed such that the circumferential velocity of the development sleeve 43 is enhanced rather than the "plain-paper mode". Therefore, the fresh toner can always supplied to a development nip part. Accordingly, the generation of the lack of density can be suppressed even if the peak-to-peak voltage is decreased to degrade the development characteristic in the "recycled-paper mode".

Figure 9:
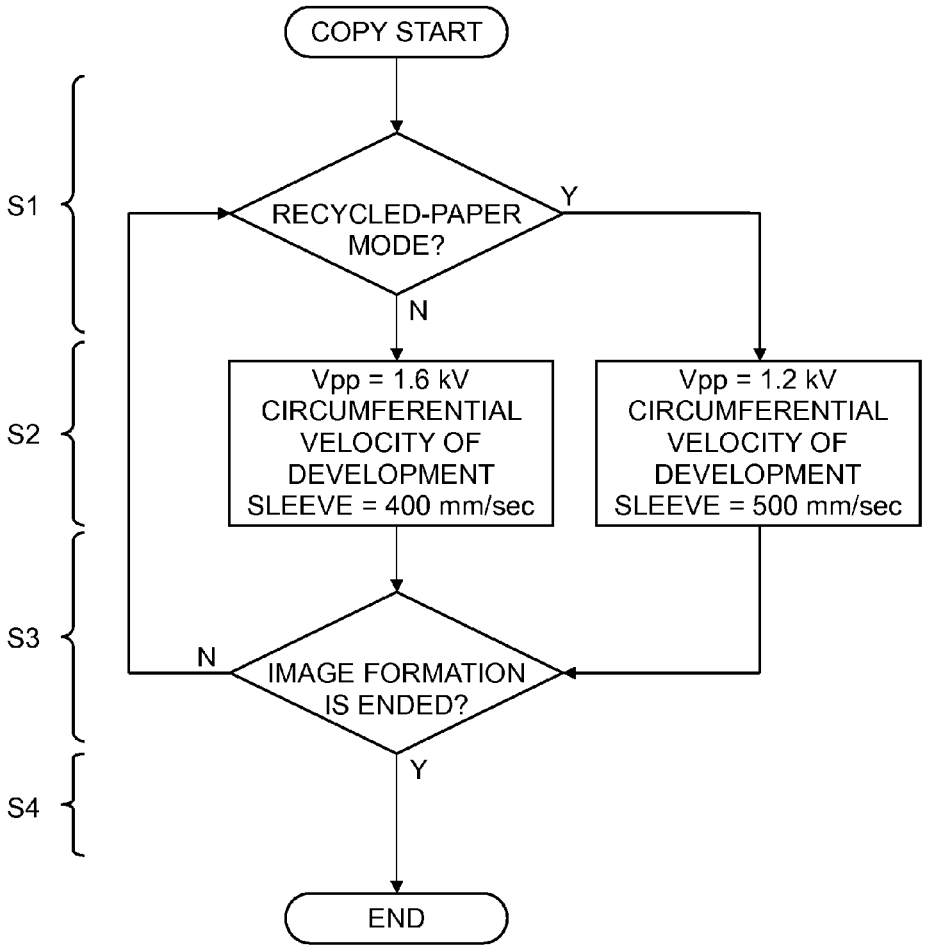
FIG. 9 is a flowchart of a second embodiment.

(Control Flow) A control flow of the second embodiment will be described in detail with reference to FIG. 9. FIG. 9 is a flowchart of the second embodiment.

When the image formation starts, the information whether the "plain-paper mode" or the "recycled-paper mode" is selected is taken in the CPU (S1). The peak-to-peak voltage Vpp of the development bias and the circumferential velocity of the development sleeve are determined based on the sheet type information taken in the CPU (S2).

When the "plain-paper mode" is selected, the peak-to-peak voltage Vpp is set to 1.6 kV, and the circumferential velocity of the development sleeve is set to 400 mm/sec. On the other hand, when the "recycled-paper mode" is selected, the peak-to-peak voltage Vpp is set to 1.2 kV, and the circumferential velocity of the development sleeve is set to 500 mm/sec.

Whether the image formation is ended is determined (S3). When the image formation is not continued, the image formation is ended (S4).

As described above, in the second embodiment, the peak-to-peak voltage Vpp of the development bias and the circumferential velocity of the development sleeve are changed according to the selected sheet type. The external additive covering state of the developed toner is controlled by the peak-to-peak voltage of the development bias according to the selected sheet type. Additionally, a lack of density, which is generated by the degradation of the development characteristic due to the decrease in peak-to-peak voltage, is suppressed by properly controlling the circumferential velocity of the development sleeve. As a result, the toner transfer characteristic can stably be maintained.

[Third Embodiment] A third embodiment will be described below. A basic configuration and operation of an image forming apparatus of the third embodiment are identical to those of the first and second embodiments. Accordingly, an element having the identical or equivalent function and configuration are designated by the identical numeral not to repeat the detailed description, and only the feature of the third embodiment is described below.

In the first and second embodiments, the toner having the high external additive coverage is selectively developed when the image is continuously formed in the "recycled-paper mode". Therefore, the toner having the low external additive coverage is gradually accumulated in the developing container 44. As a result, like the first and second embodiments, possibly the toner having the high external additive coverage is not developed even if the peak-to-peak voltage of the development bias is decreased.

Figure 10:
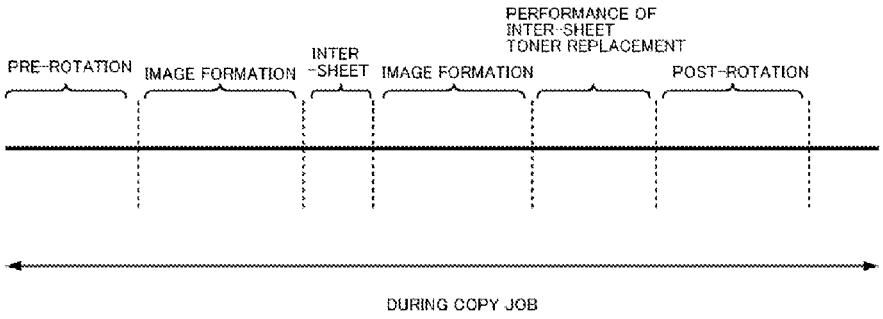
FIG. 10 is an explanatory view illustrating a toner replacing operation in a third embodiment.

In the third embodiment, in the case that the image is formed in the "recycled-paper mode", a toner replacing operation is performed in the developing container before the post-rotation after the image formation as illustrated in FIG. 10. FIG. 10 is an explanatory view illustrating the toner replacing operation in the third embodiment.

In the toner replacing operation in the third embodiment, a laser beam irradiation amount is set to a maximum light emission quantity FFH after the image formation, the electrostatic latent image is formed in a whole region in an axial direction of the photosensitive drum 2 and developed. At this point, the toner consumption amount is 500 mg. At the same time, the toner of 500 mg is replenished to the developing container.

Figure 11:
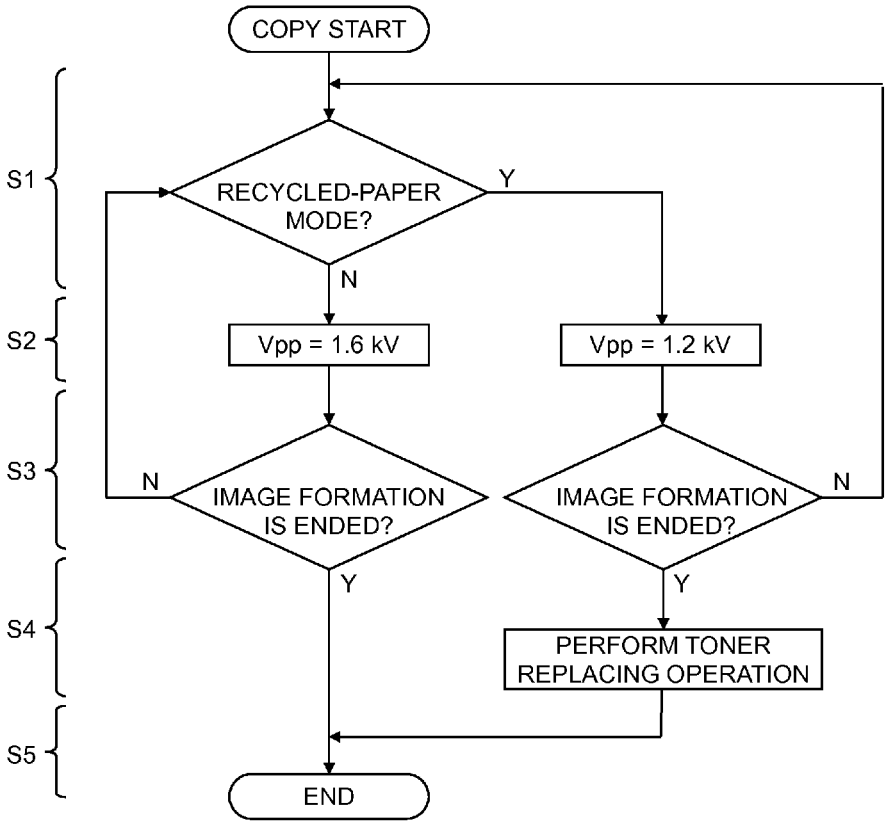
FIG. 11 is a flowchart of the third embodiment.

(Control Flow) A control flow of the third embodiment will be described in detail with reference to FIG. 11. FIG. 11 is a flowchart of the third embodiment.

When the image formation starts, the information whether the "plain-paper mode" or the "recycled-paper mode" is selected is taken in the CPU (S1). The peak-to-peak voltage Vpp of the development bias is determined based on the sheet type information taken in the CPU (S2).

The peak-to-peak voltage Vpp of 1.6 kV is applied when the "plain-paper mode" is selected, and the peak-to-peak voltage Vpp of 1.2 kV is applied when the "recycled-paper mode" is selected. Whether the image formation is ended is determined (S3). When the determination that the image forming operation is ended is made in the "recycled-paper mode", the toner replacing operation is performed (S4). The image formation is ended after the toner replacing operation.

As described above, the peak-to-peak voltage of the development bias is changed according to the selected sheet type, and the toner replacing operation is performed after the image formation when the image is formed while the peak-to-peak voltage Vpp is decreased. Therefore, the external additive covering state of the developed toner can be controlled according to the selected sheet type, and the toner transfer characteristic can stably be maintained over a long term.

In the third embodiment, the toner replacing operation is always performed after the image is formed in the "recycled-paper mode". However, it is not always necessary to perform the toner replacing operation after the image is formed in the "recycled-paper mode". For example, the controller includes a count portion that can count the number of performance times in the "recycled-paper mode", and the toner replacing operation may be performed when the number of performance times in the "recycled-paper mode", which is measured by the count portion, reaches a predetermined value.

[Fourth Embodiment] A fourth embodiment will be described below. A basic configuration and operation of an image forming apparatus of the fourth embodiment are identical to those of the first to third embodiments. Accordingly, an element having the identical or equivalent function and configuration are designated by the identical numeral not to repeat the detailed description, and only the feature of the fourth embodiment is described below.

Recently, with the downsizing of the electrophotographic apparatus, a temperature in the image forming apparatus body rises by heat generation of the fixing device and an electronic circuit board. Generally the toner has softening points of about 60 to about 80° C., and possibly the toner in the development device is softened with rising temperature of the image forming apparatus body. When the toner degradation proceeds by the softening of the toner, the external additive is buried in the toner to degrade the transfer characteristic. Therefore, particularly the uneven transfer is easily generated in a high-temperature environment.

Figure 12:
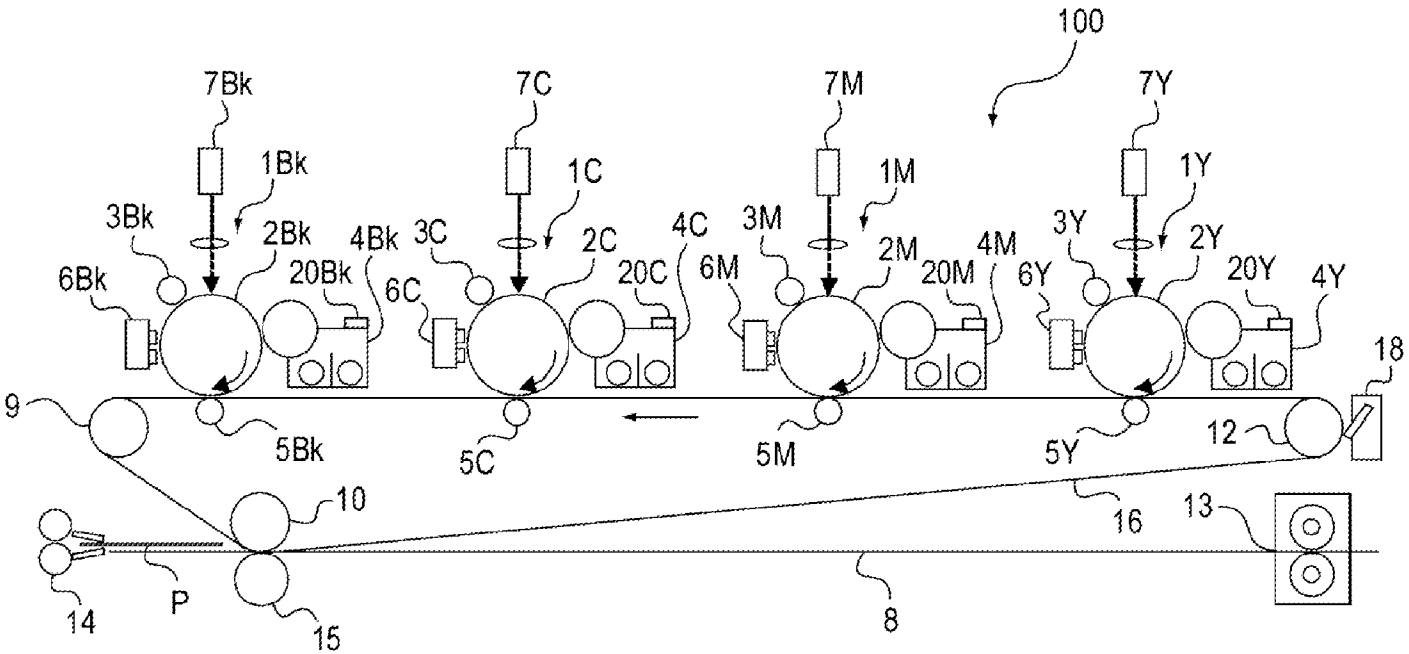
FIG. 12 is a schematic configuration diagram illustrating an example of an image forming apparatus according to a fourth embodiment.

The fourth embodiment has the following configuration. FIG. 12 is a schematic configuration diagram illustrating an example of an image forming apparatus of the fourth embodiment.

The image forming apparatus of the fourth embodiment includes development-device temperature sensors 20 (development device temperature sensing portion), which are of the toner degradation sensing portion, near the yellow, magenta, cyan, and black development devices 4. As a sensing result of the development-device temperature sensor 20, in each of the "plain-paper mode" and the "recycled-paper mode", the peak-to-peak voltage Vpp of the development bias varies according to the temperature at the development device 4.

Figure 13:
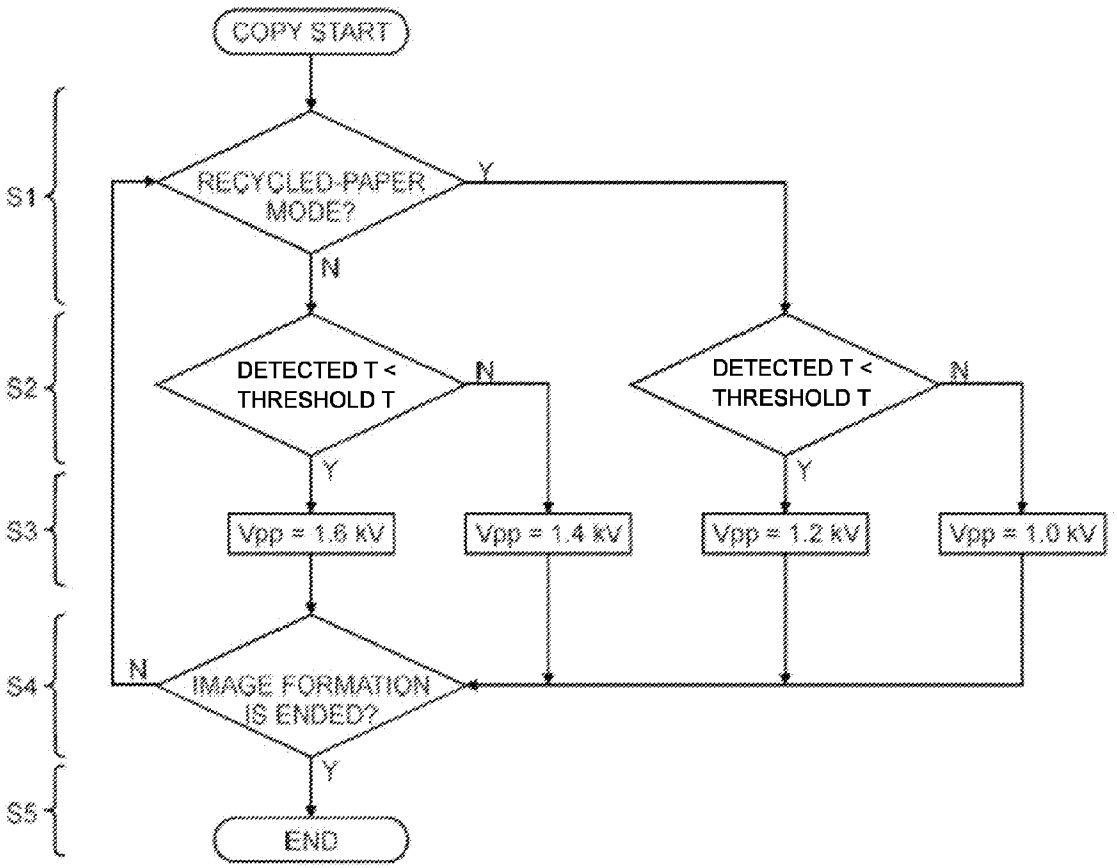
FIG. 13 is a flowchart of the fourth embodiment.

(Control Flow) A control flow of the fourth embodiment will be described in detail with reference to FIG. 13. FIG. 13 is a flowchart of the fourth embodiment.

When the image formation starts, the information whether the "plain-paper mode" or the "recycled-paper mode" is selected is taken in the CPU (S1). Here, whether it is the "plain-paper mode" or the "recycled-paper mode" is determined.

Then the development device temperature sensor 20 senses a development device temperature T_in, and the CPU 61 takes in the development device temperature information (S2). The peak-to-peak voltage Vpp of the development bias is determined based on the sheet type information and the development device temperature information taken in the CPU 61 (S3).

Specifically, the peak-to-peak voltage Vpp is set to 1.6 kV, while the "plain-paper mode" is selected, when the development device temperature T_in is less than a predetermined threshold (in the fourth embodiment, the threshold is 50° C.), namely, when the development device temperature T_in is less than 50° C. On the other hand, the peak-to-peak voltage Vpp is set to 1.4 kV, when the development device temperature T_in is greater than or equal to the predetermined threshold, namely, when the development device temperature T_in is greater than or equal to 50° C.

The peak-to-peak voltage Vpp is set to 1.2 kV, when the development device temperature T_in is less than 50° C. while the "recycled-paper mode" is selected. The peak-to-peak voltage Vpp is set to 1.0 kV, when the development device temperature T_in is greater than or equal to 50° C. while the "recycled-paper mode" is selected. Whether the image formation is ended is determined (S4). When the image formation is not continued, the image formation is ended (S5).

As described above, the peak-to-peak voltage Vpp of the development bias is changed according to the selected sheet type and the temperature at the development device. As a result, the external additive covering state of the developed toner can be controlled according to the selected sheet type, and the toner transfer characteristic can stably be maintained.

In the fourth embodiment, the predetermined threshold of the development device temperature T_in is set to 50° C. However, it is not always necessary to set the predetermined threshold to 50° C. The predetermined threshold can properly be changed depending on a surrounding environment in which the image forming apparatus is operated.

In the fourth embodiment, a level of toner degradation is sensed by measuring the development device temperature, thereby sensing whether the transfer characteristic is degraded. The invention is not limited to the fourth embodiment. For example, the case that the image having the low print coverage is continuously copied can be cited as an example of the toner degradation. In this case, the toner in the development device is not consumed too much, but the toner is agitated in the development device, and the toner is degraded. As a result, the external additive is buried in the toner to degrade the transfer characteristic. Therefore, the level of toner degradation may be sensed based on not the development device temperature but an average print coverage or the toner consumption amount to the drive time of the development sleeve. In this case, either the controller 61 that counts the video count value or the sensing portion that senses the drive time of the development sleeve can act as a degradation sensing portion. For the high level of toner degradation, the peak-to-peak voltage Vpp of the development bias may be decreased. In this case, the level of toner degradation is increased with decreasing average print coverage.

[Fifth Embodiment] A fifth embodiment will be described below. A basic configuration and operation of an image forming apparatus of the fifth embodiment are identical to those of the first to fourth embodiments. Accordingly, an element having the identical or equivalent function and configuration are designated by the identical numeral not to repeat the detailed description, and only the feature of the fifth embodiment is described below.

Figure 14:
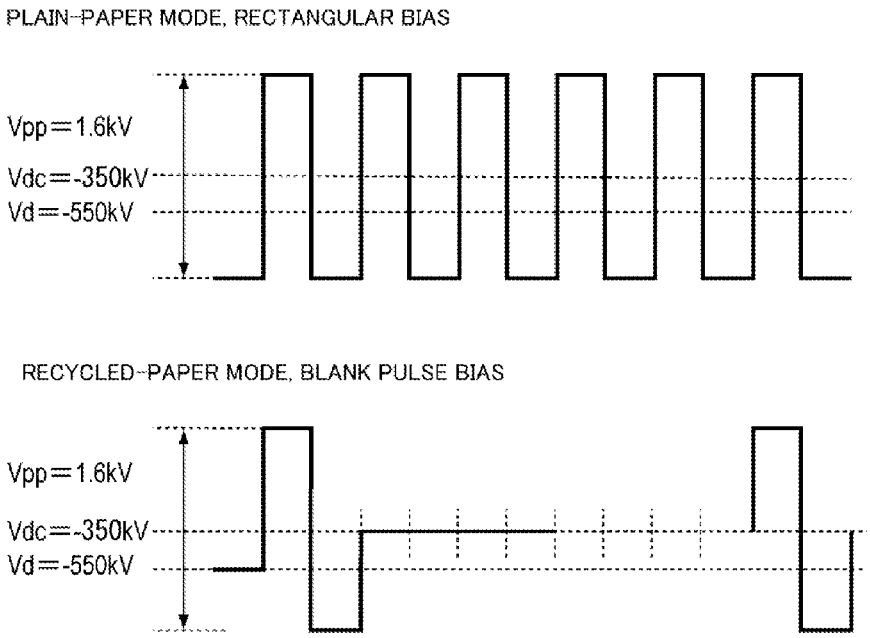
FIG. 14 is an explanatory view illustrating a development bias in a fifth embodiment.

FIG. 14 is an explanatory view illustrating a development bias in the fifth embodiment. In the fifth embodiment, two kinds of development biases are applied as illustrated in FIG. 14. One of the two kinds of development biases is the oscillation voltage in which the DC voltage of −350 V and the rectangular-waveform AC voltage having the frequency of 10.0 kHz and the peak-to-peak voltage Vpp of 1.6 kV are superposed. The oscillation voltage includes an oscillation part and a pause part. The oscillation voltage is called a "blank pulse bias" (first development bias). The other is the oscillation voltage having the frequency of 10.0 kHz and the peak-to-peak voltage Vpp of 1.6 kV. The oscillation voltage does not include the pause part. The oscillation voltage is called a "rectangular bias" (second development bias).

In the case that the "blank pulse bias" in FIG. 14 is used, the development characteristic is degraded because the pause part exists in the rectangular waveform to lengthen the development time of the DC component. The toner having the high external additive coverage is selectively developed.

Like the above embodiments, when the "plain-paper mode" is selected, the image is formed while the "rectangular bias" is applied. On the other hand, when the "recycled-paper mode" is selected, the image is formed while the "blank pulse bias" is applied.

Figure 15:
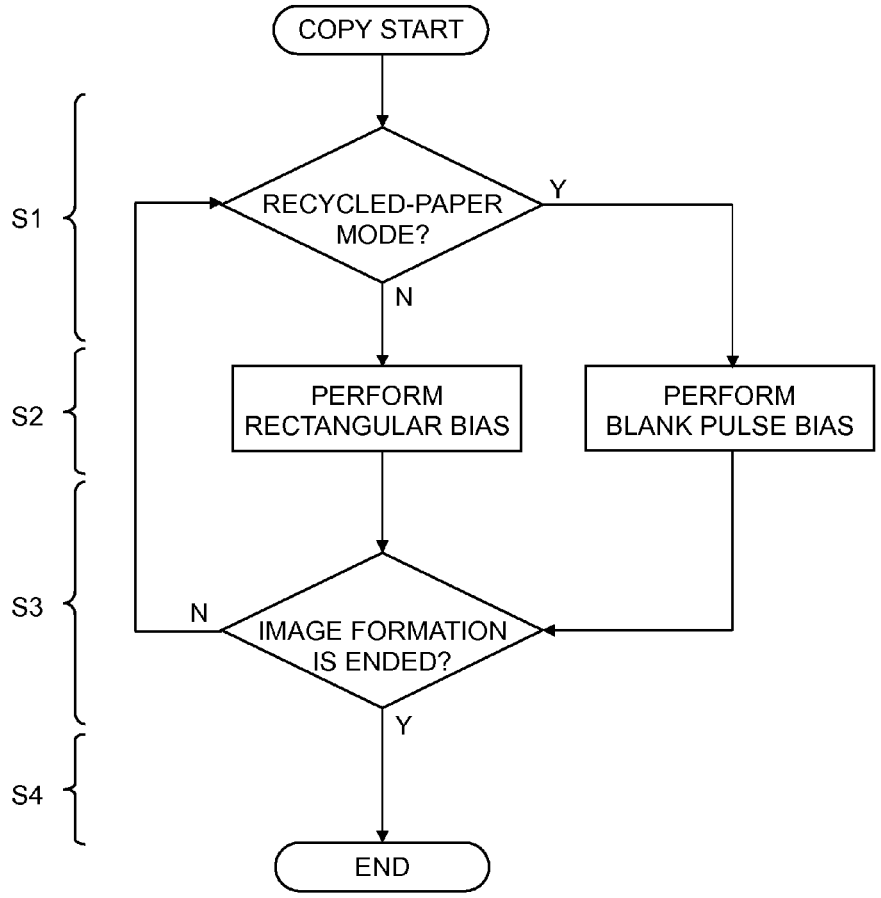
FIG. 15 is a flowchart of the fifth embodiment.

(Control Flow) A control flow of the fifth embodiment will be described in detail with reference to FIG. 15. FIG. 15 is a flowchart of the fifth embodiment.

When the image formation starts, the information whether the "plain-paper mode" or the "recycled-paper mode" is selected is taken in the CPU (S1). Here, whether it is the "plain-paper mode" or the "recycled-paper mode" is determined.

Next, the development bias is determined based on the sheet type information taken in the CPU (S2). The "rectangular bias" is applied when the "plain-paper mode" is selected. On the other hand, the "blank pulse bias" is applied when the "recycled-paper mode" is selected. Whether the image formation is ended is determined (S3). When the image formation is not continued, the image formation is ended (S4).

As described above, in the fifth embodiment, one of the "rectangular bias" and the "blank pulse bias" is applied according to the selected sheet type. As a result, the external additive covering state of the developed toner can be controlled according to the selected sheet type, and the toner transfer characteristic can stably be maintained.

[Sixth Embodiment] A sixth embodiment will be described below. A basic configuration and operation of an image forming apparatus of the sixth embodiment are identical to those of the first to fifth embodiments. Accordingly, an element having the identical or equivalent function and configuration are designated by the identical numeral not to repeat the detailed description, and only the feature of the sixth embodiment is described below.

Figure 16:
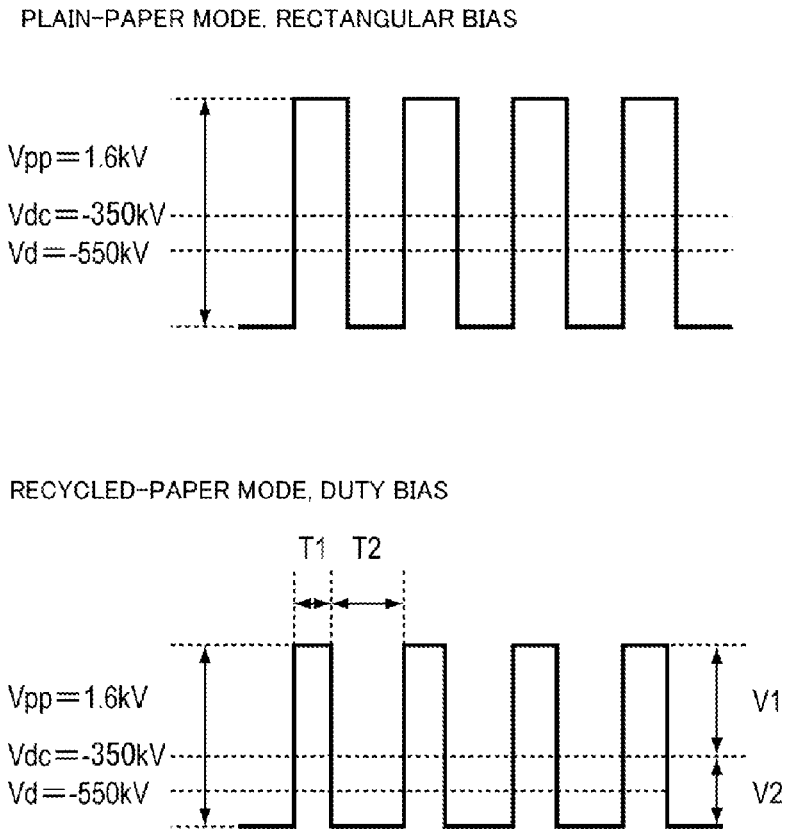
FIG. 16 is an explanatory view illustrating a development bias in a sixth embodiment.

FIG. 16 is an explanatory view illustrating a development bias in the sixth embodiment. In the sixth embodiment, two kinds of development biases are applied as illustrated in FIG. 16. One of the two kinds of development biases is the oscillation voltage in which the DC voltage of −350 V and the rectangular-waveform AC voltage having the frequency of 10.0 kHz and the peak-to-peak voltage Vpp of 1.6 kV are superposed. The oscillation voltage is called a "rectangular bias". The other is the oscillation voltage having the frequency of 10.0 kHz and the peak-to-peak voltage Vpp of 1.6 kV. The oscillation voltage is called a "duty bias".

In the case that the "duty bias" in FIG. 16 is used, the development characteristic can be controlled by adjusting the electric field that causes the toner to fly on the photosensitive drum 2. At this point, when the electric field that causes the toner to fly on the photosensitive drum 2 is weakened, the toner having the high external additive coverage can selectively be developed. In the duty bias of the sixth embodiment, a temporal axis is set to T1:T2=3:7, and a voltage axis is set to V1:V2=7:3. This is called a duty ratio. In the sixth embodiment, the duty ratio is changed according to the sheet type.

Figure 17:
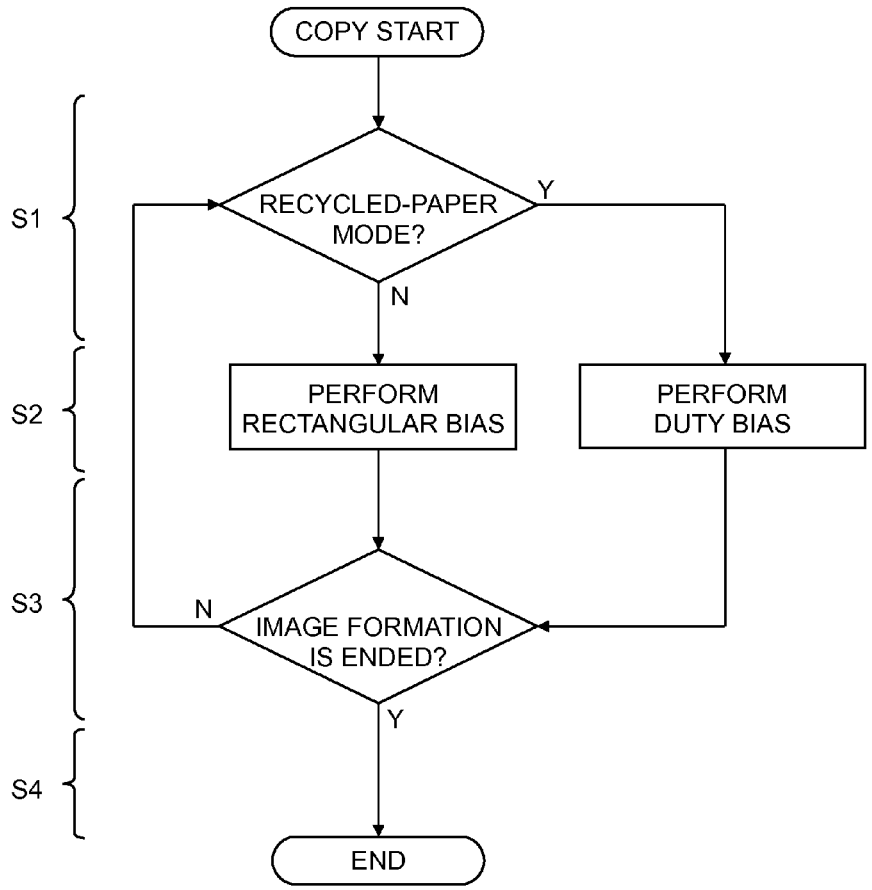
FIG. 17 is a flowchart of the sixth embodiment.

(Control Flow) A control flow of the sixth embodiment will be described in detail with reference to FIG. 17. FIG. 17 is a flowchart of the sixth embodiment.

When the image formation starts, the information whether the "plain-paper mode" or the "recycled-paper mode" is selected is taken in the CPU (S1). Here, whether it is the "plain-paper mode" or the "recycled-paper mode" is determined.

Next, the development bias is determined based on the sheet type information taken in the CPU (S2). The "rectangular bias" is applied when the "plain-paper mode" is selected. On the other hand, the "duty bias" is applied when the "recycled-paper mode" is selected. Whether the image formation is ended is determined (S3). When the image formation is not continued, the image formation is ended (S4).

As described above, the bias applying portion of the sixth embodiment can alternately apply the electric field that causes the toner to fly from the developer bearing member toward the photosensitive drum 2 and the electric field that recovers the toner from the photosensitive drum 2 toward the developer bearing member. The duty ratio of the development bias is changed according to the selected sheet type. Specifically, for the recording material having the low smoothness, the controller performs the control so as to weaken the electric field that causes the toner to fly compared with the recording material having the high smoothness. As a result, the external additive covering state of the developed toner can be controlled according to the selected sheet type, and the toner transfer characteristic can stably be maintained.

[Seventh Embodiment] A seventh embodiment will be described below. A basic configuration and operation of an image forming apparatus of the seventh embodiment are identical to those of the first to sixth embodiments. Accordingly, an element having the identical or equivalent function and configuration are designated by the identical numeral not to repeat the detailed description, and only the feature of the seventh embodiment is described below.

In the seventh embodiment, the "blank pulse bias" of the fifth embodiment is used. As described above, in the case that the "blank pulse bias" is used, because the pause part exists in the rectangular waveform, the development time of the DC component is lengthened to degrade the development characteristic. The toner having the high external additive coverage is selectively developed.

Here, in the seventh embodiment, a blank length of the "blank pulse bias" is changed according to the selected sheet type. That is, in the case that the "plain-paper mode" is selected, the image is formed using the "blank pulse bias" having the relatively short pause part. On the other hand, in the case that the "recycled-paper mode" is selected, the image is formed using the "blank pulse bias" having the relatively long pause part.

Figure 18:
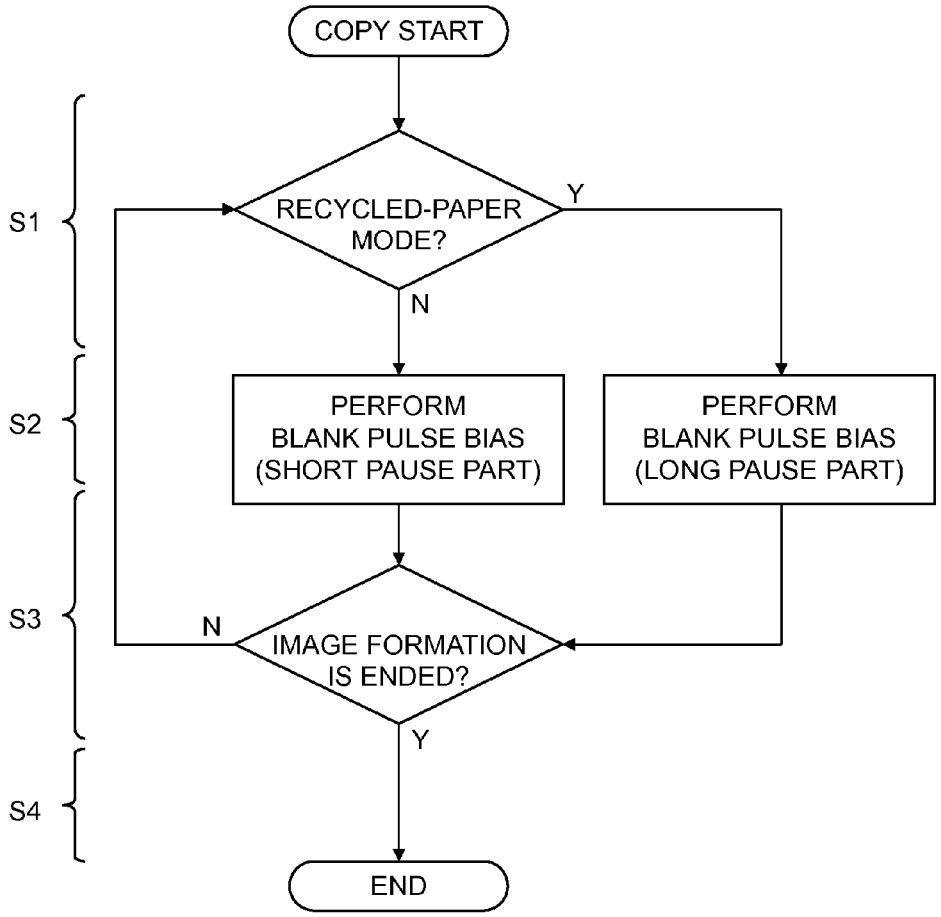
FIG. 18 is a flowchart of a seventh embodiment.

(Control Flow) A control flow of the seventh embodiment will be described in detail with reference to FIG. 18. FIG. 18 is a flowchart of the seventh embodiment.

When the image formation starts, the information whether the "plain-paper mode" or the "recycled-paper mode" is selected is taken in the CPU (S1). Here, whether it is the "plain-paper mode" or the "recycled-paper mode" is determined.

Next, the development bias is determined based on the sheet type information taken in the CPU (S2). The "blank pulse bias" having the long pause part is applied in the case that the "plain-paper mode" is selected. On the other hand, the "blank pulse bias" having the short pause part is applied in the case that the "recycled-paper mode" is selected. Whether the image formation is ended is determined (S3). When the image formation is not continued, the image formation is ended (S4).

As described above, in the seventh embodiment, the pause part (blank length) of the development bias is changed according to the selected sheet type. As a result, the external additive covering state of the developed toner can be controlled according to the selected sheet type, and the toner transfer characteristic can stably be maintained.

[Other Embodiments] It is not always necessary to solely perform each of the above embodiments, but plural embodiments may be combined within a possible range.

For example, the development bias may be switched based on both the sheet type and the level of toner degradation. For example, the development bias may be switched to degrade the development characteristic, only when the recording material has the low smoothness while the level of toner degradation is high.

In the embodiments except the fourth embodiment, whether the transfer characteristic is degraded is sensed by checking the sheet type, and the development condition is changed according to the sensing result. The invention is not limited to the cases of the embodiments except the fourth embodiment. As described in Description of the Related Art and the fourth embodiment, in addition to the sheet type, the fluidity (level of toner degradation) of the toner is cited as a factor that degrades the transfer characteristic. That is, the transfer characteristic is degraded when the fluidity of the toner is reduced (when the level of toner degradation is increased). Therefore, in the embodiments except the fourth embodiment, instead of switching the development bias according to the sheet type, the development bias may be switched according to the level of toner degradation. In this case, the development bias may be switched to degrade the development characteristic when the level of toner degradation is increased. The level of toner degradation may be sensed based on the print coverage instead of the atmospheric temperature of the development device.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-190758, filed Sep. 1, 2011, which is hereby incorporated by reference herein in its entirety.

What is claimed is:

1. An image forming apparatus comprising:

an image bearing member;

a development device that includes a developer bearing member in a development position opposite to the image bearing member to develop an electrostatic latent image formed on the image bearing member, the developer bearing member bearing and conveying a developer including a carrier and toner;

a bias applying portion that applies a development bias to the developer bearing member;

a degradation sensing portion that senses information related to a level of degradation of toner stored in the development device;

an acquisition portion that acquires information on a type of a recording material to which a toner image developed by the development device is to be transferred; and a controlling portion that controls a condition of the development bias applied to the developer bearing member so that a development ability of the development device is decreased when the degradation sensing portion senses information that the level of degradation of toner is more than a predetermined level and the acquisition portion acquires information that smoothness of the recording material is less than a predetermined reference.

2. The image forming apparatus according to claim 1, wherein the degradation sensing portion is a temperature sensing portion that senses a temperature at the development device, and the information that the level of degradation of toner is more than the predetermined level is information that the sensed temperature is higher than a predetermined temperature.

3. The image forming apparatus according to claim 1, wherein the degradation sensing portion is a print-coverage sensing portion that senses information on an average print coverage of an output image, and the information that the level of degradation of toner is more than the predetermined level is information that the average print coverage of an output image is lower than a predetermined average print coverage.

4. The image forming apparatus according to claim 1, wherein the bias applying portion can apply an oscillation voltage to the developer bearing member, and the development ability of the development device is decreased by reducing peak-to-peak voltage of AC voltage applied to the developer bearing member.

5. The image forming apparatus according to claim 1, wherein the bias applying portion can apply a first development bias having a waveform including an oscillation part and a pause part and a second development bias having a waveform including only the oscillation part, and the development ability of the development device is decreased by changing development bias applied to the developer bearing member from the second development bias to the first development bias.

6. The image forming apparatus according to claim 1, wherein the bias applying portion can apply a development bias having a waveform including an oscillation part and a pause part, and the controlling portion decreases the development ability of the development device by elongating a biasing period of the pause part.

7. The image forming apparatus according to claim 1, wherein the bias applying portion can alternately apply an electric field that causes the toner to fly from the developer bearing member toward the image bearing member and an electric field that recovers the toner from the image bearing member toward the developer bearing member, and the controlling portion decreases the development ability of the development device by weakening the electric field that causes the toner to fly from the developer bearing member toward the image bearing member.

8. The image forming apparatus according to claim 1, the controlling portion increases rotation speed of the developer bearing member in a case of changing to a condition that the development ability of the development device is degraded.

* * * * *